United States Patent [19]

Noguchi

[11] 4,229,784

[45] Oct. 21, 1980

[54] LAMPSTAND FOR LAMPSHADE

[76] Inventor: Isamu Noguchi, 333 E. 69th St., New York, N.Y. 10021

[21] Appl. No.: 27,361

[22] Filed: Apr. 5, 1979

Related U.S. Application Data

[62] Division of Ser. No. 850,790, Nov. 11, 1974.

[51] Int. Cl.[2] ..... F21S 1/12

[52] U.S. Cl. ..... 362/414; 362/311; 362/361; 362/417; 362/431

[58] Field of Search ..... 362/361, 431, 414, 311, 362/417

[56] References Cited

U.S. PATENT DOCUMENTS

| | | | |
|---|---|---|---|
| 1,863,767 | 6/1932 | Shapiro | 362/361 |
| 2,343,173 | 2/1944 | Dupler | 362/361 |
| 4,167,034 | 9/1979 | Noguchi | 362/417 |

*Primary Examiner*—Stephen J. Lechert, Jr.

*Attorney, Agent, or Firm*—Michael Ebert

[57] ABSTRACT

A lampstand providing a stable and properly-oriented support for a lampshade, particularly one constituted by an oriental lantern formed by a collapsible paper shell having polar openings, each of which is bridged by a strut having a central loop. The stand includes a vertical pole carrying a bulb socket and a harp formed by a triad of arms which encage the bulb and interconnect upper and lower rings. The lower ring is secured to the pole and the upper ring supports an extension rod in axial alignment with the pole. The lantern is mounted on the stand to envelop the bulb, the upper loop being attached to the head of the extension rod, the lower loop engaging the pole at a point just below resilient collar which embraces the pole and is shiftable to a position subjecting the lantern to tension to maintain the shell thereof in its fully expanded state. Extension rods of different length may be installed on the harp to allow for centering of the bulb for a range of shade sizes.

3 Claims, 9 Drawing Figures

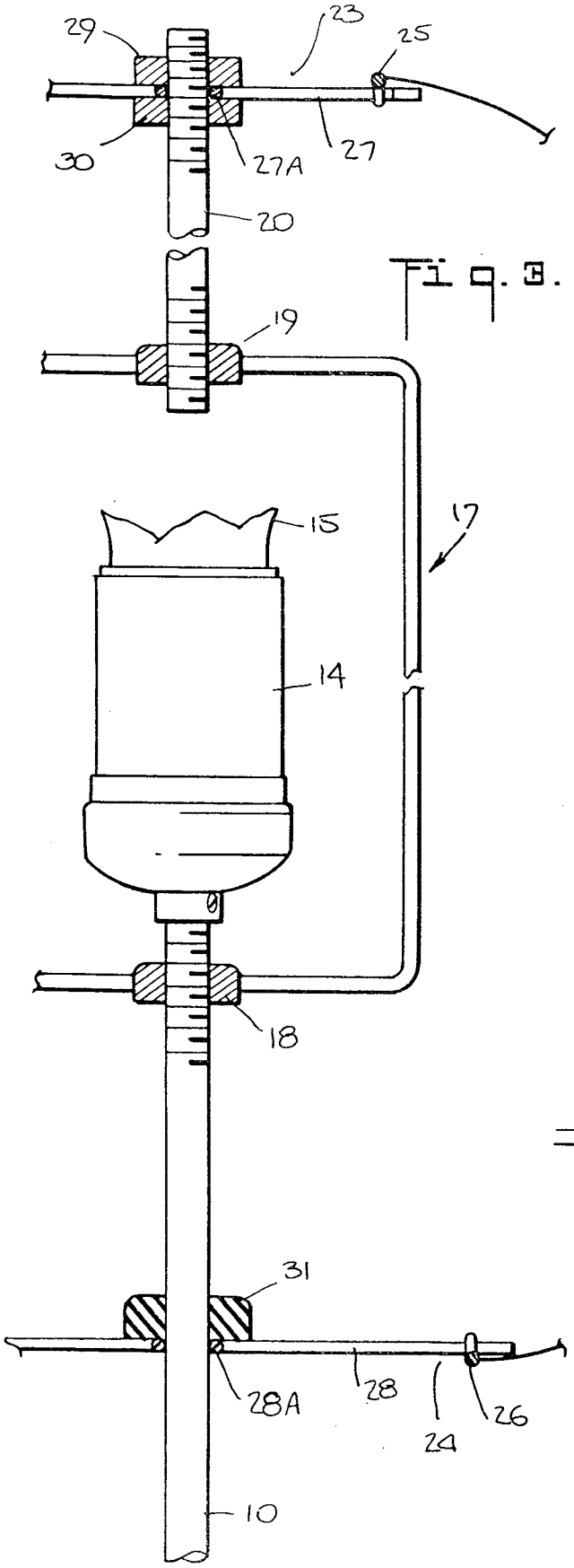
Fig. 3.
Fig. 7.
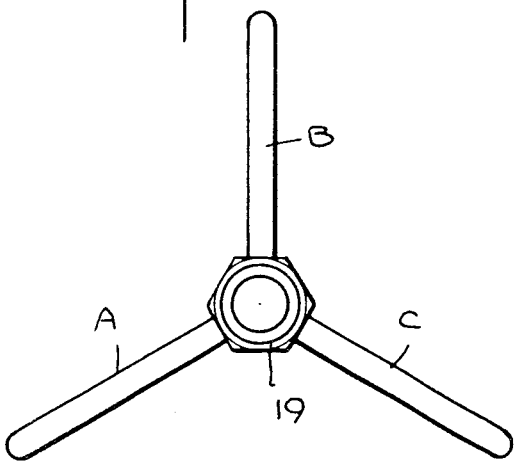
Fig. 8.
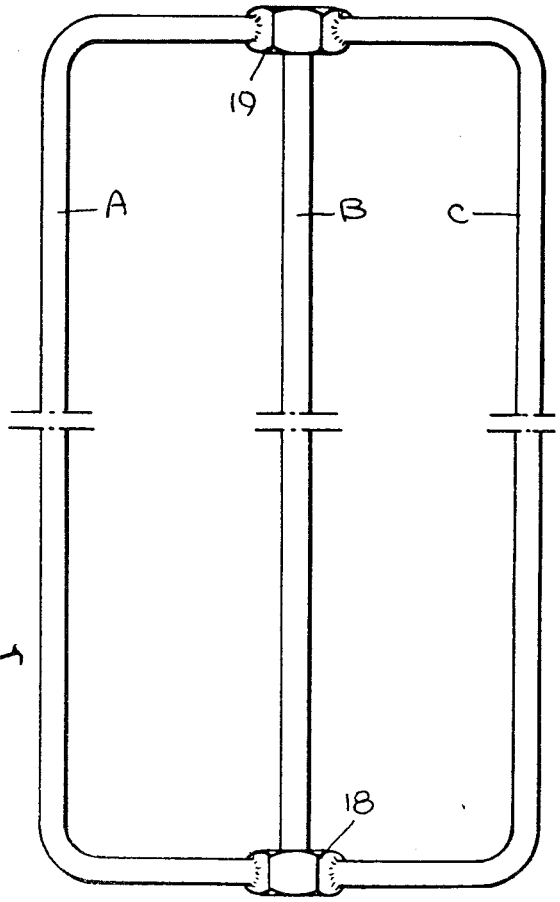

Fig. 5.
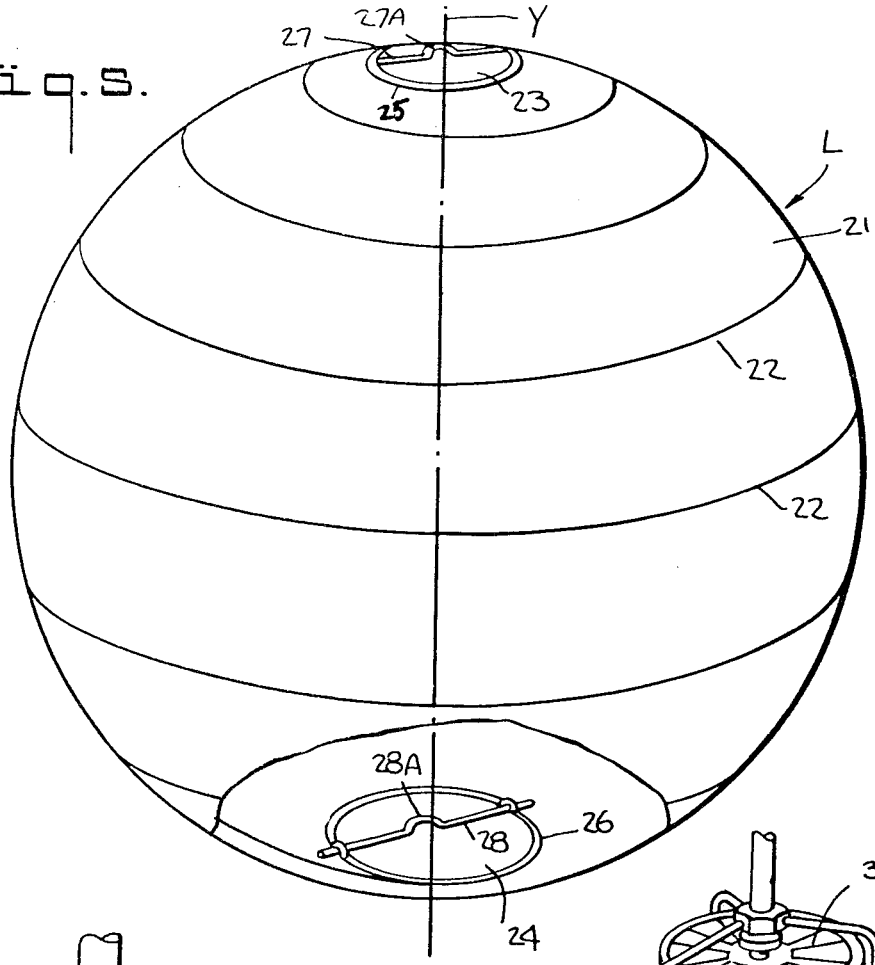
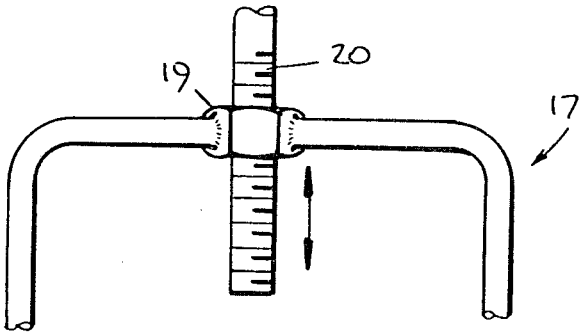
Fig. 4.
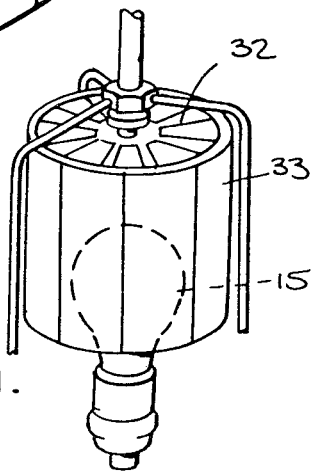
Fig. 9.
Fig. 6.
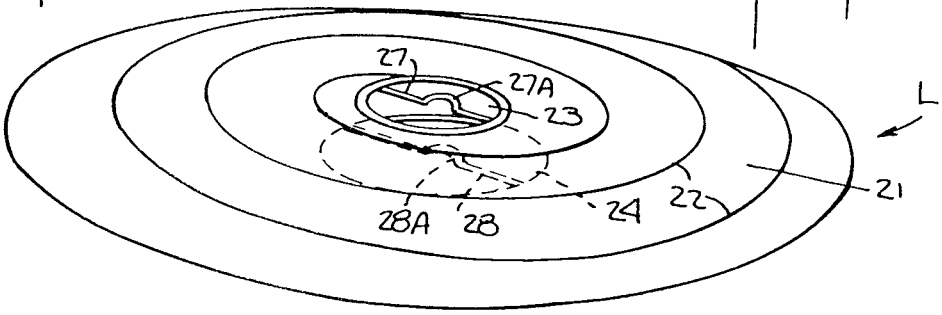

LAMPSTAND FOR LAMPSHADE

RELATED APPLICATION

This application is a division of my copending application of the same title, Ser. No. 850,790, filed Nov. 11, 1977.

BACKGROUND OF INVENTION

This invention relates generally to table and floor lamps, and more particularly to a lamp whose stand provides a stable and properly-oriented support for a lampshade.

The typical floor or table lamp consists of a stand in the form of a rod or pole ahchored on a weighted base and carrying a socket for a light bulb, the pole also supporting a harp to which a lampshade is attachable.

The conventional harp is composed of a wire hoop defined by a pair of opposed arms which extend upwardly from a ring attached to the pole of the lampstand below the bulb socket. Clamped to the top of the harp is a fixture from which a short threaded stud extends. The typical lampshade includes a spider whose arms radiate from a central collar receivable on the harp stud and secured thereto by a nut.

The stability of the harp of the hoop type depends on the stiffness of the wire from which it is formed. In practice, it is usually possible, particularly with a large shade, to produce a sufficient moment about the point of attachment, to bend and deform the harp and thereby tilt the shade. Moreover, while the fixture on top of the harp is clamped thereto, it has a tendency to turn on the hoop when a force is applied to the shade in a direction producing a torque, the spider acting as a lever providing a mechanical advantage.

As a consequence, one often finds that with a conventional floor or table lamp which from time to time is handled to change its room placement, that the lampshade assumes an improper orientation on the stand. In trying to correct this condition, the homeowner usually manipulates the wire spider in the hope of straightening out the shade position. More ofter than not, this simply worsens the situation.

The problem of lampshade orientation with a cnventional lampstand is even more vexatious when the shade is in the form of a Chinese or Japanese lantern (hereinafter referred to as an oriental lantern). One lantern of this type is composed of a translucent thin paper or fabric shell of spheroidal form having reinforcing bamboo ribs in spiral form embedded therein, the shell being provided with polar openings bordered by circular ribs.

When oriental lanterns of different size are suspended from a conventional harp with the upper polar rib attached to the harp fixture, then one not only is faced with the problem of an off-center shade orientation as a result of an imperfect harp position but also with the problem of centering the bulb within the lantern as well as the problem of maintaining the collapsible lantern in a fully-expanded state. With a conventional lampstand arrangement, one cannot subject the lantern shell to tension to fully expand its form. While it is known to install a wire stretcher within a lantern to tension the shell, such stretchers are not usable when the lantern is mounted on a lampstand harp.

SUMMARY OF INVENTION

In view of the foregoing, the main object of this invention is to provide a floor or table lamp whose stand provides a stable and properly-oriented support for a lampshade and which, by a choice of extension rods of different lengths, allows for centering of the bulb within shades of different size.

More particularly, it is an object of this invention to provide a lamp whose stand includes a fixed harp formed by an array of at least three wires that encage the bulb received in the socket carried by the stand pole and interconnect upper and lower rings, the lower ring being secured to the pole and the upper ring supporting an extension rod in axial alignment with the pole.

A significant feature of a harp in accordance with the invention is that the wire array is highly resistant to deflection and deformation and therefore acts to maintain the proper orientation of the shade supported thereby. Another advantage of this arrangement is that the extension rod supported by the upper ring is of variable length and may be axially-adjusted so that the lower end of the rod more or less projects within the harp to change the effective height of the rod and thereby elevate the lampshade to a desired position relative to the bulb.

Also an object of this invention is to provide a lampstand for a collapsible oriental lantern which serves not only to properly orient the lantern on the stand but also to subject the lantern to tension to maintain the lantern in its fully expanded state.

Still another object of this invention is to provide a lampstand for oriental lanterns of different size, the arrangement being such that regardless of the size of the lantern, the proper amount of tension may be applied thereto.

Briefly stated, these objects are attained in a lampstand that includes a vertical pole anchored in a base and carrying a bulb socket and a harp formed by a symmetrical array of at least three arms which encage the bulb and interconnect upper and lower rings, the lower ring being secured to the pole below the socket and the upper ring supporting an extension rod in axial alignment with the pole.

The lampshade preferably takes the form of an oriental lantern constituted by a spheroidal, collapsible shell having polar openings, each of which is bridged by a strut having a central loop. The lantern is mounted on the stand to envelop the bulb, the upper loop being attached to the head of the extension rod and the lower loop engaging the pole at a point just below a resilient collar which embraces the pole and is shiftable thereallong to push the lower loop to a position subjecting the lantern to tension to maintain the shell thereof in its fully expanded state.

In the event the shade is of the type having a bridge with a central loop only at the top thereof and does not require tension, an extension rod of the appropriate length serves to elevate the shade to its proper height to center the light bulb.

OUTLINE OF DRAWINGS

For a better understanding of the invention as well as other objects and further features thereof, reference is made to the following detailed description to be read in conjunction with the accompanying drawings, wherein:

FIG. 3 is a longitudinal section taken through the lamp shown in FIG. 1;

FIG. 4 is a detail showing how the effective height of the extension rod on the harp may be adjusted;

FIG. 5 is a perspective of the oriental lantern in its fully expanded state;

FIG. 6 shows the same lantern in its collapsed state;

FIG. 7 is a top plan view of the harp on the stand;

FIG. 8 is a side elevation view of the harp; and

FIG. 9 shows a modification in which the rod on the harp supports a propelled optical filter surrounding the bulb.

DESCRIPTION OF INVENTION

Figure 1:
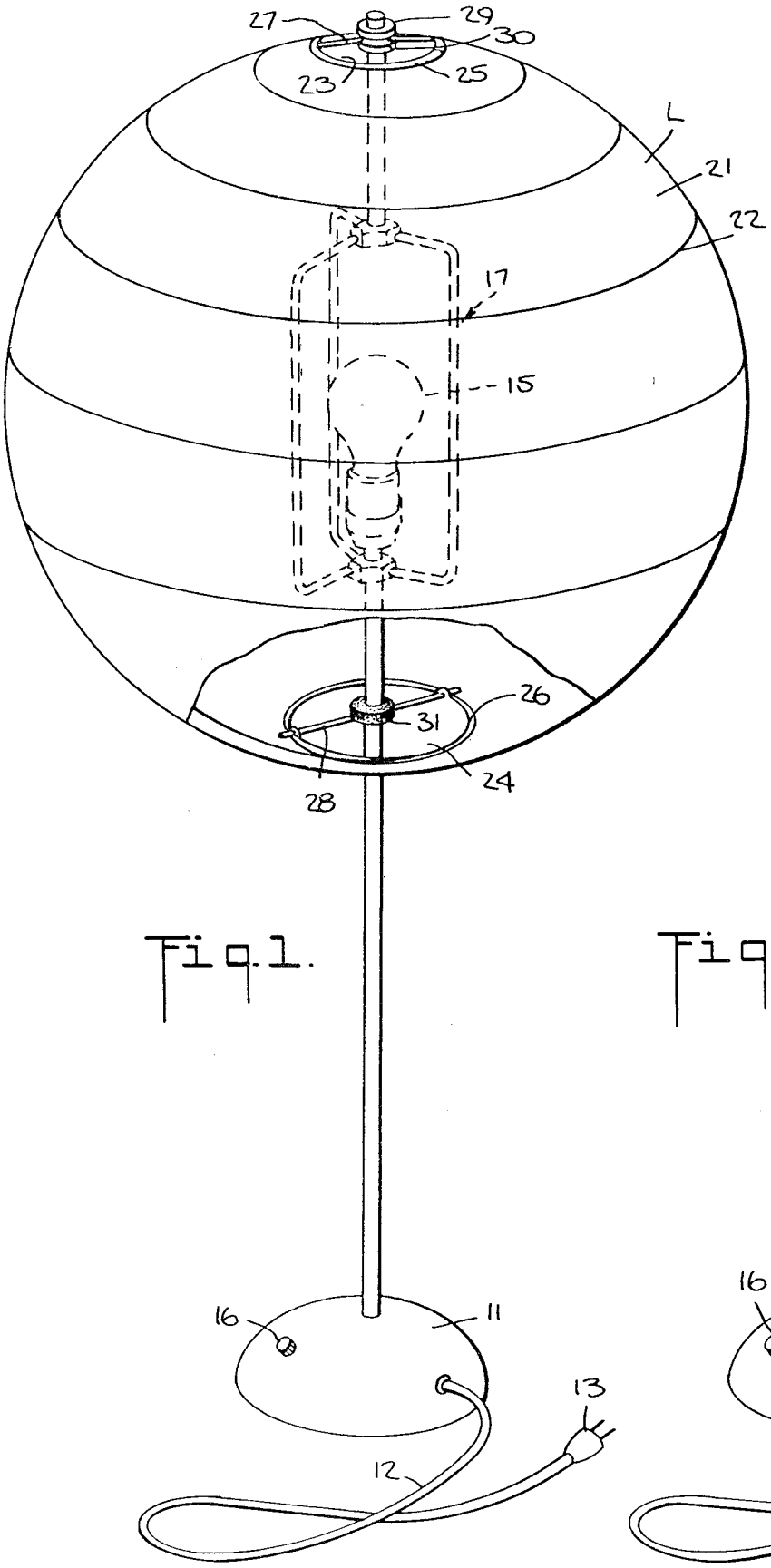
FIG. 1 is a perspective view of a floor or table lamp in accordance with the invention, which makes use of an oriental lantern as a lampshade, the lantern being cut away at the bottom to reveal the manner in which it is attached to the stand.
Figure 2:
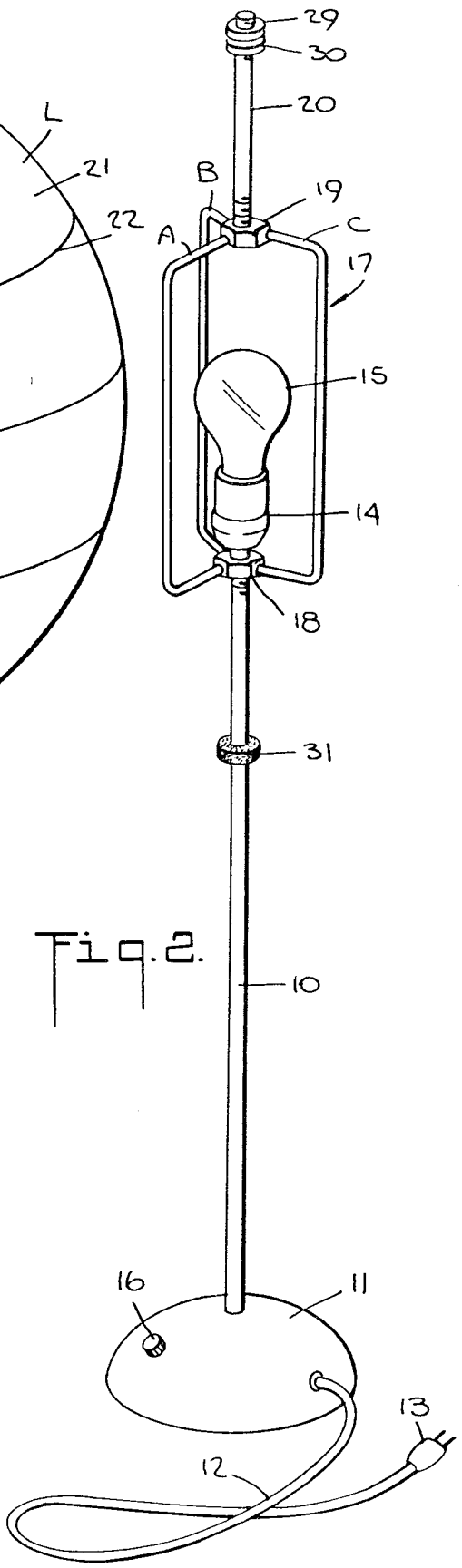
FIG. 2 is a perspective view of the lampstand without the lantern.

Referring now to FIGS. 1 and 2, there is illustrated a table or floor lamp in accordance with the invention, the lamp including a vertical pole 10 anchored on a weighted base 11. The lamp cable 12, which is provided with a plug 13 insertable in an electrical outlet, passes into base 11 and extends through pole 10 which is hollow to connect with a bulb socket 14 carried on the threaded head of the pole to receive a light bulb 15. Base 11 is provided with a power switch 16. The length of pole 10 determines whether the lamp is usable as a table or floor lamp.

Also carried by pole 18 is a harp 17 constituted by a symmetrical triad of wires A, B and C which encage bulb 15, the ends of the wires being welded to interconnect a lower ring 18 to an upper ring 19. Though rings 18 and 19 are shown in the form of hexagonal nuts which are internally threaded, in practice they may take the form of circular rings which are unthreaded and are attached by means of set screws. And while harp 17, as shown, is formed by a symmetrical array of three wires, in practice, the array may include a greater number of wires, the spacing therebetween being sufficient to admit the bulb into its socket.

Lower ring 18 is secured to pole 10 just below socket 14, whereas upper ring 19 serves to support a variable-length extension rod 20 which is threaded at either end and is in axial alignment with vertical pole 10. As shown in FIG. 4, by turning extension rod 20, one can more or less project the lower end thereof into the harp and thereby vary the effective height of the rod projecting above ring 19 to adjust the elevation of a lampshade supported on the head of the rod.

Because ring 19 has a three-point wire support, it resists displacement and acts to maintain extension rod 20 in its proper vertical position. One can, with a stand of the type shown in FIG. 2, mount a conventional lampshade thereon; that is, one having a spider provided with a central collar, the collar being received on extension rod 20 and being secured thereto by nuts.

The stand is particularly useful as a support for a collapsible oriental lantern of the type shown separately in FIGS. 5 and 6. This lantern, generally designated as L, is composed of a thin shell 21 of translucent paper or fabric having a spheroidal form and reinforced by a bamboo spiral rib 22 embedded in the paper. Shell 21 is provided with upper and lower polar openings 23 and 24. Opening 23 is bordered by a circular rib 25 and opening 24 by a circular rib 26. Lower opening 24 has a larger diameter than the upper opening, the lower opening being large enough to permit one to pass the lantern over the harp. In practice, the lantern may be in other geometric configurations, such as cylindrical or cubical, the inclusion of a reinforcing rib being optional.

Bridging upper opening 23 is a wire strut 27 which is shaped to define a loop 27A at its midpoint. Similarly bridging lower opening 24 is a strut 28 having a midpoint loop 28A, the two loops being exactly aligned with the longitudinal axis Y of the lantern.

In mounting the lantern on the stand, upper loop 27A is clamped between nuts 29 and 30 received on the threaded head of extension rod 20. Lower loop 28A engages pole 10 of the stand at a point just below a collar 31. Collar 31 is fabricated of a resilient plastic or Neoprene material whose hole is dilatable to embrace the pole. The collar is shiftable along the pole to push loop 28A downwardly to a point subjecting the shell of the lantern to sufficient tension to maintain it in its fully expanded position.

Hence when one wishes to replace the lantern, first collar 31 is shifted upwardly on the pole to release the tension on the lantern and to permit disengagement of lower loop 28A therefrom, after which the upper loop 27A is detached from the extension rod to permit withdrawal of the lantern from the stand.

Not only is it possible with a stand in accordance with the invention to vary the effective height of the extension rod within the limits determined by the length of threading on the lower end of the rod, but one may entirely replace rod 20 with a longer or shorter rod to accommodate lanterns of different dimensions which cannot be mounted by means of a given rod 20. Thus one may provide rods in 2, 6, 9, 12 and 30 inch lengths to support shades of different sizes at positions which effectively center the bulb therein.

The lower threaded end of rod 20 may be used to support the hub bearing of a propeller 32 which, as shown in FIG. 8, is caused to turn by the flow of rising air resulting from the heat radiated by bulb 15. The propeller is arranged to support a cylindrical translucent filter 33 surrounding the bulb. The filter includes colored or patterned sections, so that as the propeller and the filter rotate, the light emitted by the bulb is modulated to create vari-colored or other decorative light effects.

While there has been shown and described a preferred embodiment of a lampstand for lampshade in accordance with the invention, it will be appreciated that many changes and modifications may be made therein without, however, departing from the essential spirit thereof. Thus instead of anchoring the pole in a base, it may be anchored on a bracket attachable to a wall.

I claim:

1. A fixture for supporting a lampshade, said fixture comprising:

A a vertical pole having a socket attached to its upper end to receive a light bulb;

B a harp constituted by a symmetrical array of at least three U-shaped wires arranged to encage said bulb, each wire having a vertical arm and horizontally-extending lower and upper legs, the lower legs being joined to a lower ring attached to said pole at a point below the socket, the upper legs being joined to an upper ring in axial alignment with the pole; and C an extension rod anchored in said upper ring and extending upwardly therefrom to provide a mounting for said lampshade.

2. A fixture as set forth in claim 1, wherein said harp is composed of three wires whose legs are 120 degrees apart.

3. A fixture as set forth in claim 1, wherein said rings are internally threaded, the lower ring being received on a threaded portion of said pole, the lower end of the extension rod being threadably received in the upper ring.

* * * * *